US006920903B2

(12) United States Patent
Ansier et al.

(10) Patent No.: US 6,920,903 B2
(45) Date of Patent: Jul. 26, 2005

(54) APPARATUS AND METHOD FOR REFURBISHING USED CARTRIDGES FOR INK JET TYPE IMAGING DEVICES

(76) Inventors: Mark James Ansier, 5300 Cedro Trail, Austin, TX (US) 78731; Frank Jemela, 2315 Prince Jeffrey La., Katy, TX (US) 77493

( * ) Notice: Subject to any disclaimer, the term of this patent is extended or adjusted under 35 U.S.C. 154(b) by 0 days.

(21) Appl. No.: 10/693,340

(22) Filed: Oct. 24, 2003

(65) Prior Publication Data

US 2004/0261891 A1 Dec. 30, 2004

Related U.S. Application Data

(60) Provisional application No. 60/482,052, filed on Jun. 24, 2003.

(51) Int. Cl.[7] ..... B65B 3/12

(52) U.S. Cl. ..... 141/2; 141/18; 141/192; 141/329; 141/382; 222/80; 222/643

(58) Field of Search ..... 141/2, 18, 20.5, 141/98, 192, 329, 382; 222/80–82, 173, 638–9, 642–3; 347/85–7; 606/116, 185–6; 81/9.22

(56) References Cited

U.S. PATENT DOCUMENTS

| | | | | | |
|---|---|---|---|---|---|
| 3,949,746 | A | * | 4/1976 | Wallach | 604/152 |
| 5,154,324 | A | * | 10/1992 | Stratford | 222/175 |
| 5,709,253 | A | * | 1/1998 | Maerzke | 141/18 |
| 5,883,652 | A | * | 3/1999 | Moser et al. | 347/85 |
| 6,065,371 | A | * | 5/2000 | Yacowitz | 81/9.22 |

* cited by examiner

*Primary Examiner*—Justine R. Yu
*Assistant Examiner*—Peter deVore

(57) ABSTRACT

An inkjet cartridge refurbishing apparatus includes a pump assembly with a fluid intake line that can be inserted into a bottle or other reservoir of ink or flushing/cleaning material. Connected to the output of the pump assembly is a fill gun having a fill needle mounted on a handle. The fill gun is operated by inserting the fill needle into an inkjet cartridge and actuating a fill trigger switch on the fill gun. Actuating the fill trigger switch activates the pump assembly to pump ink into the cartridge. An auto-cutoff device may control the volume of fluid pumped into the cartridge.

20 Claims, 3 Drawing Sheets

APPARATUS AND METHOD FOR REFURBISHING USED CARTRIDGES FOR INK JET TYPE IMAGING DEVICES

CROSS-REFERENCE TO RELATED APPLICATION

This application is related to U.S. Provisional Patent Application Ser. No. 60/482,052 filed Jun. 24, 2003, and entitled, "APPARATUS AND METHOD FOR REFURBISHING USED CARTRIDGES FOR INK JET TYPE IMAGING DEVICES." The Applicants claim the benefit of this prior provisional application under 35 U.S.C. §119(e). The entire content of this provisional application is incorporated herein by this reference.

TECHNICAL FIELD OF THE INVENTION

The invention is directed to the refurbishment of inkjet cartridges used in inkjet type imaging devices such as printers, photocopiers, and facsimile machines, for example. The invention encompasses devices for refurbishing used inkjet cartridges and methods for refurbishing such cartridges.

BACKGROUND OF THE INVENTION

Inkjet imaging devices produce text and images on a substrate such as paper by ejecting minute quantities of ink from a reservoir onto the substrate in response electrical commands. The electrical commands activate small orifices or inkjets in a print head to eject the ink in the desired locations to form the desired images. Because the ink in an inkjet imaging device is used up eventually in the printing process, conventional inkjet imaging devices include the ink reservoir in a replaceable cartridge commonly referred to as an inkjet cartridge. The print head containing the orifices through which the ink is ejected is also commonly included in the replaceable inkjet cartridge. The remainder of the inkjet imaging device includes electrical control components and mechanical components for moving the inkjet cartridge with respect to the printing substrate (paper) and for moving the substrate with respect to the inkjet cartridge.

Photocopiers, printers, plotters, and facsimile machines are examples of devices that may utilize an inkjet printing or imaging process. As used in this disclosure "inkjet device" encompasses any type of device using an inkjet process. Also, for purposes of the following description, the portion of the inkjet device other than the inkjet cartridge will be referred to herein simply as an inkjet device whether or not the inkjet cartridge is installed. The portion of the inkjet device that carries the consumable ink for the inkjet imaging process will be referred to as an inkjet cartridge (also referred to throughout this disclosure simply as a "cartridge") regardless of the particular design and regardless of the other components included on the device such as a print head and associated electrical lines and contacts.

FIG. 1 is a view in perspective of a typical prior art inkjet cartridge 100. Inkjet cartridge 100 includes a container 101 adapted to contain a supply of ink (the ink not being shown in the figure). The bulk of container 101 is generally rectangular in shape with a lower portion 102 projecting from the rest of the container. Print head assembly 104 is located on lower portion 102 of container and includes a large number of minute, electrically stimulated orifices or inkjets 105 through which ink from container 101 is ejected in the printing process. It will be appreciated that the orifices or inkjets are shown diagrammatically in FIG. 1 in an exaggerated scale, and that the orifices are in fact very small in order to produce the desired image resolution. The commands or electrical stimuli required to operate the orifices or inkjets 105 are applied to print head assembly 104 through electrical conductors 106 which terminate at contact pads 107 on a side of container 101. An inkjet printing device in which cartridge 100 is to be used will include a corresponding set of electrical contacts exposed so as to make contact with contact pads 107 on the cartridge. The electrical signals required for operating print head assembly 106 originate from a print control system (not shown) included in the inkjet imaging device. The illustrated prior art inkjet cartridge 100 also includes additional orifices facilitating fluid communication to ink container 101. The first additional orifice comprises an opening 109 commonly referred to as a vent opening or vent hole. The second additional orifice comprises an opening which is commonly referred to as a maze opening or maze hole located on the surface of cartridge 100 indicated by arrow 110. The maze hole is associated with a ball that functions as a check valve to prevent the flow of material out of container 101.

Due to space limitations and other physical restrictions in inkjet devices, inkjet cartridges typically have a relatively limited supply of the ink for use in the inkjet printing process. The working life of the print head assembly of an inkjet cartridge is, in fact, commonly much greater than the working life of the ink supply in the cartridge. Thus, although original equipment manufactures may prefer for inkjet device users to use totally new inkjet cartridges due to the relatively high profit margins associated with selling new inkjet cartridges, it is commonly possible to refurbish and reuse inkjet cartridges many times before they are no longer serviceable. The refurbishing equipment, however, must be easy to use and relatively inexpensive in order to maximize the price advantage of the refurbished inkjet cartridges over new inkjet cartridges.

SUMMARY OF THE INVENTION

The present invention includes both apparatus and methods for refurbishing inkjet cartridges. An inkjet cartridge refurbishing apparatus according to the present invention includes a pump assembly with a fluid intake line (also referred to throughout this disclosure as an "ink intake," an "ink intake line," or an "intake line") which can be inserted into a bottle or other reservoir of ink or flushing/cleaning material. Connected to the output of the pump assembly is a fill gun (also referred to throughout this disclosure as an "inkjet cartridge fill gun" or simply a "gun") having a fill needle mounted on a handle. The fill gun is operated by inserting the fill needle into an inkjet cartridge and activating a fill trigger switch on the fill gun to activate the pump assembly and pump ink into the cartridge.

An inkjet cartridge refurbishing apparatus according to the invention preferably includes an auto-cutoff device that controls the volume of fluid pumped into the cartridge. The auto-cutoff device may include a timer that can be set to a certain length of time. The timer is activated when the fill trigger switch is actuated and causes the auto-cutoff device to send a control signal to deactivate the pump assembly when the time has run out.

In some forms of the invention a kill switch is provided on the fill gun. The kill switch is preferably positioned as a thumb-activated switch which may be actuated to initiate a signal to turn off the pump assembly.

A method of refurbishing an inkjet cartridge according to the present invention includes the steps of inserting the fill needle of the fill gun into the inkjet cartridge, inserting a fluid intake line into an ink supply, and activating the pump. Once activated, the pump transfers ink from the ink supply to the fill needle and into the inkjet cartridge. The method also includes deactivating the pump after a desired volume of ink is transferred to the cartridge.

The present invention provides a convenient and inexpensive apparatus and process for refurbishing an inkjet cartridge. The apparatus and process are particularly well adapted for low volume inkjet cartridge refurbishing operations. These and other advantages and features of the invention will be apparent from the following description of the preferred embodiments, considered along with the accompanying drawings.

DESCRIPTION OF PREFERRED EMBODIMENTS

Figure 2:
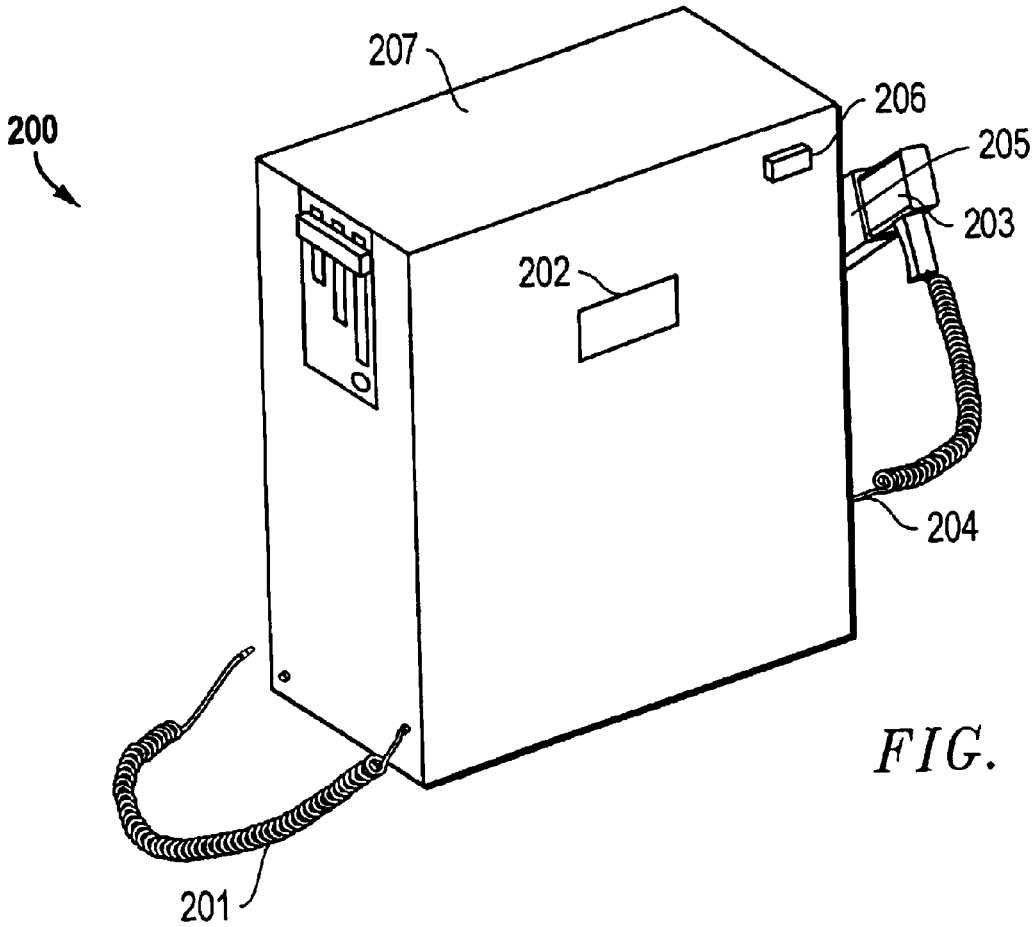
FIG. 2 is a front perspective view of an inkjet cartridge refurbishing system embodying the principles of the present invention.

FIG. 2 illustrates an inkjet cartridge refurbishing system 200 embodying the principles of the invention. The illustrated system includes a housing 207 to which a fluid intake line 201 and a fill gun 203 are connected. Housing 207 houses various components of the present system including a pump assembly that receives fluid through fluid intake line 201 and drives the fluid to fill gun 203 through an ink supply/control line 204. The pump assembly will be described in detail with reference to FIG. 3. A timer display 202 is provided on the front panel of the housing 207. Timer display 202 is associated with a timer device that is used in the present system to control the pump operation as will be described below with reference to FIG. 3. An on/off actuator 206 located on a front panel of housing 207 operates a suitable switch to control power to the electrical components of the system.

Figure 1:
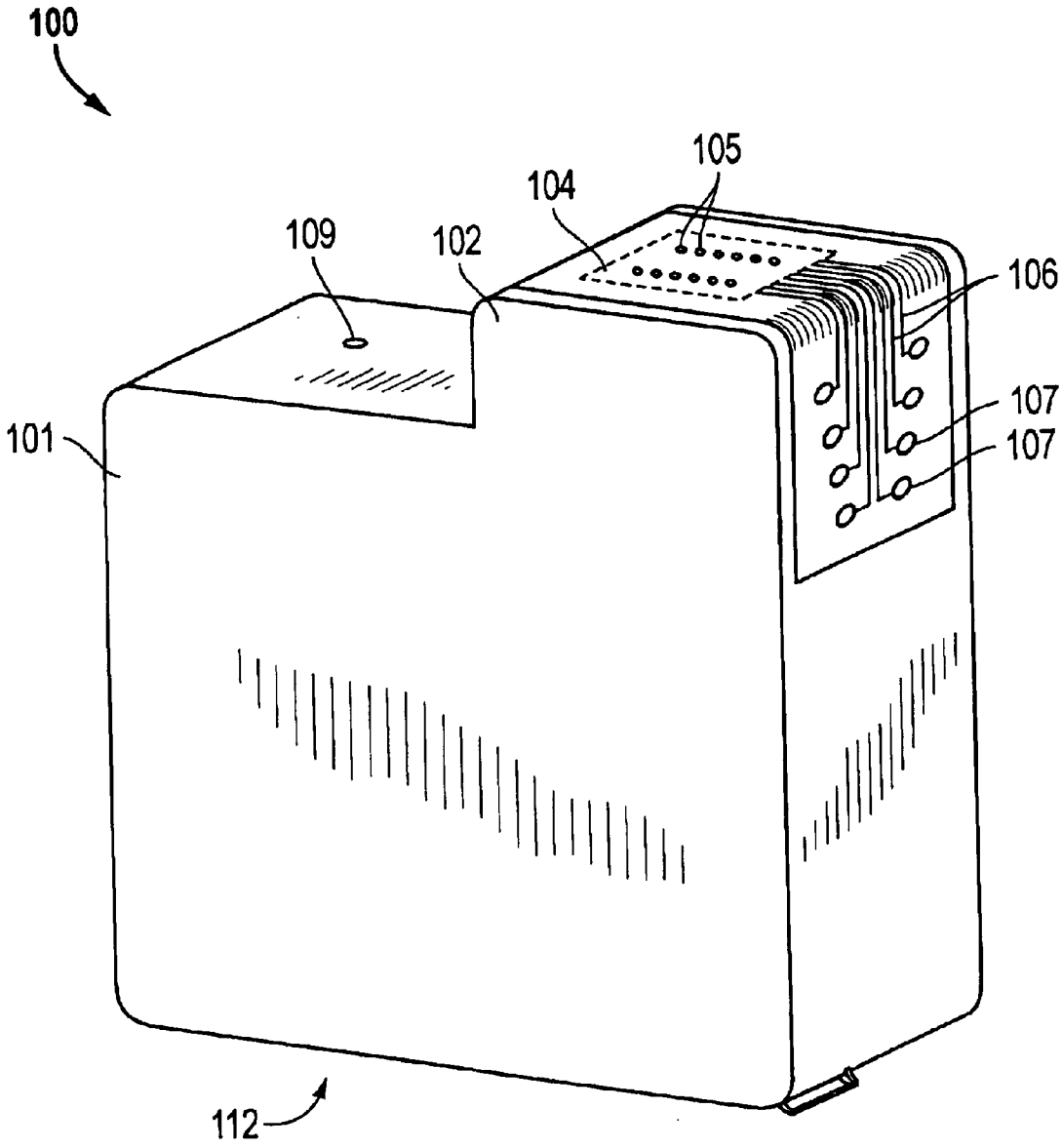
FIG. 1 (Prior Art)
FIG. 1 is a view in perspective of a prior art inkjet cartridge of a type that may be refurbished according to the present invention.

The preferred form of inkjet cartridge refurbishing system shown in FIG. 1 also includes a holster 205 mounted on housing 207 in position to receive and store fill gun 203 when the fill gun is not in use. Also, the illustrated system 200 includes a fill needle rack 208 mounted on housing 207 for holding replacement fill needles of different sizes and shapes. The fill needles are used with fill gun 203 and will be described further below especially with reference to FIG. 4.

As will be described in detail below with reference to FIG. 4, the pump assembly in housing 207 and fill gun 203 are adapted to measure a desired amount of ink into an inkjet cartridge to refill the depleted inkjet cartridge. It should also be noted that fluid intake line 201 can be inserted into a black ink supply or colored ink supplies, and can also be used to flush the system with a cleaner fluid or to transfer other types of fluids into other receptacles.

Figure 3:
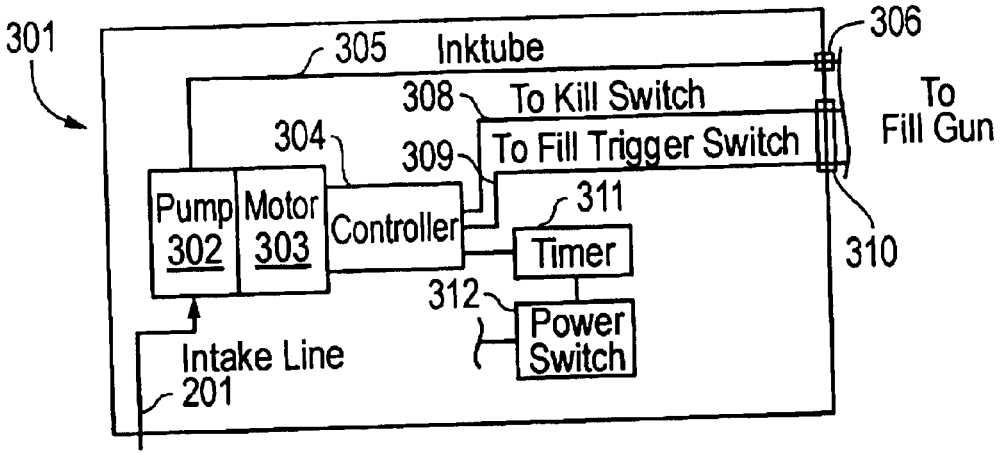
FIG. 3 is a diagrammatic representation of the inkjet cartridge refurbishing system shown in FIG. 2.

FIG. 3 provides a diagrammatic representation of the various components of inkjet cartridge refurbishing system 200 that are housed in the illustrated housing 207 in FIG. 1. In particular, FIG. 3 shows a pump assembly 301 that includes a pump 302 driven by a suitable motor 303. Pump assembly 301 also includes a pump intake connected to intake line 201, and a pump outlet connected to ink outlet line 305 (also referred to throughout this disclosure as an "ink outlet" or "outlet line"). Outlet line 305 extends to a suitable fitting 306 on an external surface of housing 207. A controller 304 is also included in pump assembly 301 for controlling the operation of pump 302 in response to suitable control signals at control inputs of the controller.

The controller 304 of pump assembly 301 includes a number of control inputs, each connected to a respective electrical control line that extends to a switch mounted on the fill gun as will be described further below with reference to FIG. 4. FIG. 3 shows a separate control line 308 for a kill switch and a separate control line 309 for a fill trigger switch. In the preferred form of the invention, the electrical control lines extend from the controller 304 to a suitable fitting 310 on an external surface of housing 207. A suitable connecting line connects to this fitting 310 and extends to the fill gun as will be described below with reference to FIG. 4. As discussed above with reference to FIG. 2, the electrical connecting line adapted to connect to fitting or connector 310 may be combined with a suitable ink conduit (also referred to throughout this disclosure as an "ink supply conduit" or a "supply conduit") that connects between fitting 306 and the fill gun 203 to form a single line such as supply/control line 204 in FIG. 2.

FIG. 3 also shows that controller 304 is associated with a timer 311 and a power switch 312 connected to a suitable electrical power supply (not shown in FIG. 3) for driving the pump motor 303. As will be described further below, the timer 311 comprises an auto-cutoff device used to control the pump 302 to supply a desired volume of ink to fill an inkjet cartridge being refurbished and then automatically cut off flow of ink to the cartridge. Timer 311 may be set through timer display 202 shown in FIG. 2, and may also be used to provide control options such as continuous pump operation or pulsed pump operation.

Figure 4:
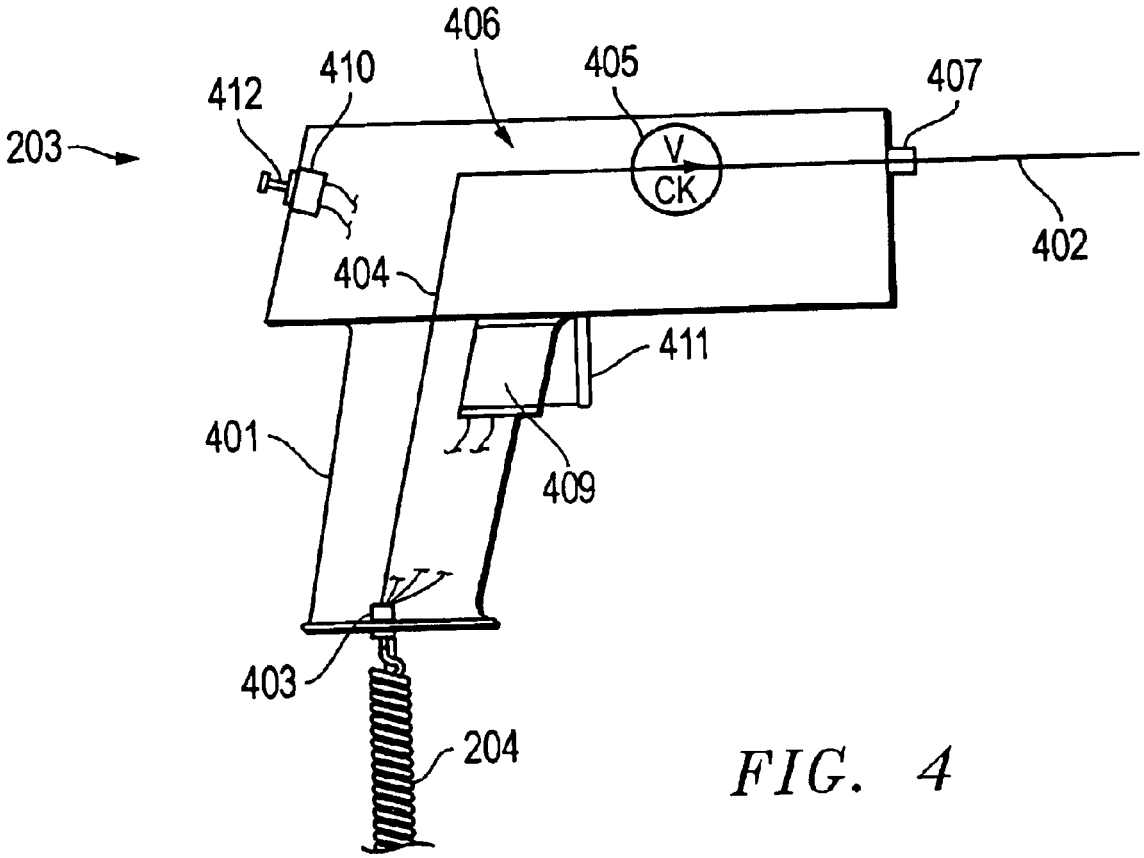
FIG. 4 is a mostly diagrammatic representation of the inkjet cartridge fill gun included in the inkjet cartridge refurbishing system shown in FIG. 2.

FIG. 4 shows a somewhat diagrammatic representation of the fill gun 203 shown also in FIG. 2. Fill gun 203 includes a handle with a pistol-type grip or grip portion 401. Fill gun also includes a fill needle 402 preferably connected to the gun with a suitable needle connector 407, such as a threaded connector, for example, that allows the needle to be easily removed from the gun and replaced as necessary. A fitting 403 is also included on fill gun 203 for making a connection with ink supply line/electrical control line 204. It will be noted that in the illustrated preferred form of the invention grip portion 401 extends transverse to the longitudinal axis of fill needle 402.

In the form of fill gun shown in FIG. 4, a supply fitting arrangement (also referred to throughout this disclosure as an "ink supply fitting arrangement") shown generally at 406 couples fill needle 402 to the ink conduit portion of ink supply line/control line 204. This supply fitting arrangement encompasses a conduit 404, needle connector 407, and a supply fitting 403 preferably located at the base or bottom of grip portion 401. A suitable check valve 405 is also preferably included in conduit 404 to prevent ink from flowing back an the direction from fill needle 402 to ink supply line/control line 204.

Fill gun 203 also includes two switches, a start switch 409 and a kill switch 410. Fill trigger switch 409 is activated through a trigger actuator 411, while kill switch 410 is activated through a separate button actuator 412. Fill trigger switch 409 and trigger actuator are preferably located adjacent to a leading or forward edge of grip portion 401, facing in the same direction as fill needle 402. Kill switch 410 and its actuator button are preferably located on the opposite side of the handle from trigger actuator 411 and trigger switch 409.

The operation of the inkjet refurbishing apparatus 200 according to the invention may now be described with reference to FIGS. 1 through 4. In order to fill an empty inkjet cartridge such as that shown in FIG. 1, the user first withdraws the fill gun 203 from its holster 205 on housing 207 and inserts the distal end of needle 402 into an orifice on the particular inkjet cartridge. The user also sets the timer 311 to run the pump 302 for a particular time. Since the pump 302 runs at a known speed and moves a known volume of ink in any given time, setting the timer 311 has the effect of setting the volume of ink to be supplied to the cartridge. Once timer 311 is set and the needle is appropriately placed in the empty cartridge, the user depresses the trigger actuator 411 to actuate fill trigger switch 409. The controller 309 uses the signal initiated at start switch 409 to start motor 303 and cause pump 302 to start dispensing ink through needle 402. Motor 303 continues to run until timer 311 runs down to zero at which point the timer 311 provides a suitable control input to motor controller 309 to stop or deactivate motor 303, and thus stop the flow of ink into the cartridge. At any point in the process the user may also depress kill switch actuator 412 to provide a signal to motor controller 309 to deactivate motor 303 before receiving a signal from the 311. The user may wish to use the kill switch feature for example when fill needle 402 proves to be incorrectly placed in the inkjet cartridge and ink does not flow into the cartridge as desired.

It will be noted that the refurbishing system may be used both to clean a used inkjet cartridge and to fill the cleaned cartridge with ink. For cleaning a cartridge, intake line 201 may be inserted in a reservoir of suitable cleaning fluid, and the system may be operated to pump the cleaning fluid into a cartridge being refurbished. After circulating cleaning fluid through the cartridge, intake line 201 may be withdrawn from the cleaning fluid and inserted into a reservoir of ink. The system may then be operated to fill the cleaned cartridge with ink.

Many inkjet imaging devices have color printing capability. Typically, imaging devices having color printing capability use both an inkjet cartridge containing black ink for black and white or grey scale printing and a separate cartridge containing three different colors of ink for use in color printing. Refurbishing color inkjet cartridges with the present system includes separately filling each separate colored ink reservoir with its respective colored ink. Between filling operations for each different color of ink, the present system must be flushed to remove ink of the color used in the previous filling operation. The system may be flushed by inserting intake line 201 into a suitable flushing fluid and then operating the pump to force the flushing fluid though the various conduits in the system and ultimately through fill needle 402 to flush out the previously used ink.

Although the illustrated form of the invention includes a timer for measuring the volume of ink supplied to fill the inkjet cartridge, other forms of the invention may use different arrangements for metering the volume of ink into a cartridge. For example, the volume of ink supplied to refill a cartridge may be measured directly from a suitable positive displacement pumping device.

The inkjet cartridge refurbishing system 200 described above has particular application in a retail inkjet cartridge refurbishing arrangement. Because the system 200 with its highly adaptable fill gun is able to refurbish substantially any inkjet cartridge, the system can be employed in a retail arrangement in which a user brings their used cartridge to the retail refurbishing center, drops a cartridge off for refurbishment, and then later picks up the refurbished cartridge after the cartridge has been refurbished at the retail location. This is in contrast to prior inkjet cartridge refurbishing systems in which the cartridge had to be sent away to a central refurbishing facility. In another variation of the refurbishment arrangement, the user may trade in their used cartridge for a refurbished cartridge. An operator then uses the system 200 to refurbish the used cartridge and make it available to another customer dropping off a like cartridge.

In any refurbishment application, retail or production, certain additional equipment may be required to ensure the refurbished cartridge is in a usable state. For example, a testing unit such as Makro Micro Company, Croatia, Model CT8 or CT56 may be used to test each refurbished cartridge to ensure it is in proper working order prior to distribution to a customer or return to the user who dropped off the cartridge for refurbishment.

It will be noted that the basic components of the system illustrated in FIG. 2 may vary widely within the scope of the present invention. For example, while FIG. 2 shows a combined ink supply/control line 204, the individual components in the line may be separated. That is, rather than including the ink supply conduit and control lines in a single line 204, the ink supply conduit and the control lines may be entirely separate lines. Also, any number of fitting arrangements may be used to make the required connections between conduits in the system. A preferred pump 302 comprises a peristaltic pump, however, substantially any type of pump may be used to drive ink to the fill needle and into the cartridge being refurbished according to the invention. Other variations within the scope of the invention include different handle configurations other than the pistol-grip configuration shown in FIG. 4. It will also be appreciated that there is a large variety of control circuits that may be used according to the invention to control the operation of pump assembly 301 through various switches and through a volume controller such as timer 311. Furthermore, the invention is not limited to the timer based auto-cutoff device described above, rather any device adapted to cut off the flow of ink to the fill gun and fill needle after a given volume of fluid has been transferred may be used the present cartridge refurbishing system.

The above-described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. An inkjet cartridge refurbishing system including:

(a) a pump assembly having an ink intake, an ink outlet, and a control input, the ink outlet being connected to a proximal end of a supply conduit; and (b) a fill gun having a fill needle, a handle connected to the fill needle, a kill switch, and a fill trigger switch provided on the handle, the fill needle being connected to receive fluid directed through the supply conduit, the fill trigger switch being operatively connected to the control input so as to selectively apply a control signal to the control input, and the kill switch being located on the handle and being operable to selectively deactivate the pump assembly from pumping ink through the supply conduit to the fill needle.

2. The inkjet cartridge refurbishing system of claim 1 wherein the kill switch is located on the handle on a side substantially opposite of the fill trigger switch.

3. The inkjet cartridge refurbishing system of claim 1 wherein the handle includes a grip portion extending transverse to a longitudinal axis of the fill needle, and wherein the fill trigger switch is located adjacent to a leading edge of the grip portion.

4. The inkjet cartridge refurbishing system of claim 1 further including an auto-cutoff device being operable to automatically deactivate the pump assembly.

5. The inkjet cartridge refurbishing system of claim 4 wherein the auto-cutoff device includes a timer and wherein the auto-cutoff device is operable to automatically deactivate the pump assembly after a set period of operation measured by the timer.

6. The inkjet cartridge refurbishing system of claim 1 further including:

(a) a housing having the pump assembly mounted in an interior thereof; and (b) a fill gun holster mounted on an exterior of the housing.

7. The inkjet cartridge refurbishing system of claim 6 wherein the supply conduit extends from the housing to a supply conduit fitting on the handle of the fill gun.

8. The inkjet cartridge refurbishing system of claim 1 wherein the pump assembly is a peristaltic pump assembly.

9. A method of refurbishing an inkjet cartridge, the method including the steps of:

(a) inserting a fill needle of a fill gun into the inkjet cartridge;

(b) activating a fill trigger switch on the fill gun to activate a pump assembly to transfer ink from an ink intake line to the fill needle and into the inkjet cartridge;

(c) detecting a configuration error; and (d) responsive to the configuration error, actuating a kill switch on the fill gun to deactivate the pump assembly.

10. The method of claim 9 further including the step of setting an auto-cutoff device to deactivate the pump assembly after a desired volume has been pumped.

11. The method of claim 9 further including the step of inserting the ink intake line into a cleaner fluid supply prior to activating the pump assembly.

12. The method of claim 11 further including the step of withdrawing the ink intake line from the cleaner fluid supply and inserting the ink intake line into an ink supply.

13. An inkjet cartridge fill gun including:

(a) a fill needle;

(b) an ink supply fitting arrangement connected to the fill needle to enable the fill needle to be connected to receive a flow of ink from an ink supply conduit;

(c) a handle connected to the fill needle;

(d) a fill trigger switch provided on the handle, the fill trigger switch being operable when activated to initiate a pump assembly control signal; and (e) a kill switch located on the fill gun, the kill switch being selectively operable to initiate a kill signal for use in stopping a flow of ink through the ink supply conduit to the fill needle.

14. The inkjet cartridge fill gun of claim 13 wherein the handle includes a grip portion extending transverse to a longitudinal axis of the fill needle and the fill trigger switch is located adjacent to a leading edge of the grip portion.

15. The inkjet cartridge fill gun of claim 14 wherein the kill switch is located on a side of the handle opposite from the fill trigger switch.

16. The inkjet cartridge fill gun of claim 13 further including a needle connector between the fill needle and the ink supply fitting arrangement, the needle connector being configured to allow removal and replacement of the fill needle.

17. The inkjet cartridge fill gun of claim 13 wherein the ink supply fitting arrangement includes a check valve operable to prevent a reverse flow of ink in direction from the fill needle to the ink supply conduit.

18. An apparatus including:

(a) a pump assembly having an ink intake, an ink outlet, and a control input, the ink outlet being connected to a proximal end of a supply conduit;

(b) a fill gun having a fill needle, a handle connected to the fill needle, and a fill trigger switch provided on the handle, the fill needle being connected to receive fluid directed through the supply conduit, and the fill trigger switch being operatively connected to the control input so as to selectively apply a control signal to the control input; and (c) an auto-cutoff device that includes a timer, the auto-cutoff device being operable to automatically deactivate the pump assembly after a set period of operation measured by the timer.

19. A method including:

(a) inserting a fill needle of a fill gun into an inkjet cartridge;

(b) activating a fill trigger switch on the fill gun to activate a pump assembly to transfer ink from an ink intake line to the fill needle and into the inkjet cartridge;

(c) deactivating the pump assembly; and (d) inserting the ink intake line into a cleaner fluid supply prior to activating the pump assembly.

20. The method of claim 19 further including withdrawing the ink intake line from the cleaner fluid supply and inserting the ink intake line into an ink supply.

* * * * *